United States Patent [19]

Funahashi

[11] 4,054,093

[45] Oct. 18, 1977

[54] SELF-INKING HAND STAMP

[76] Inventor: Takaji Funahashi, No. 1, 2-chome, Kitatakasho, Nishi, Nagoya, Aichi, Japan

[21] Appl. No.: 428,759

[22] Filed: Dec. 27, 1973

[30] Foreign Application Priority Data

| | | |
|---|---|---|
| Jan. 29, 1973 | Japan | 48-11751 |
| Sept. 4, 1973 | Japan | 48-103705[U] |

[51] Int. Cl.[2] ..... B41F 31/00; B41K 1/38

[52] U.S. Cl. ..... 101/327; 101/372

[58] Field of Search ..... 101/371, 372, 373, 111, 101/327, 332, 399, 398, 109

[56] References Cited

U.S. PATENT DOCUMENTS

| | | | |
|---|---|---|---|
| 628,766 | 7/1899 | Cooke | 101/373 |
| 745,244 | 11/1903 | Schulz | 101/373 |
| 749,655 | 1/1904 | Bartholomew | 101/373 |
| 1,093,485 | 4/1914 | Scotford et al. | 101/373 X |
| 1,275,813 | 8/1918 | Wilday | 101/373 |
| 1,377,786 | 5/1921 | Packard | 101/109 X |
| 3,442,209 | 5/1969 | Funahashi | 101/327 |
| 3,478,682 | 11/1969 | Funahashi | 101/327 |
| 3,631,799 | 1/1972 | Funahashi | 101/327 |

*Primary Examiner*—Russell R. Kinsey
*Assistant Examiner*—Paul J. Hirsch
*Attorney, Agent, or Firm*—Bucknam and Archer

[57] ABSTRACT

A stamp for imprinting the date, time, name of an organization or company, and so on, which comprises a subsidiary imprint body having on its surface a plurality of circumferentially arranged subsidiary imprint sections, and a disc-shaped main imprint body having on its surface a main imprint section and a marking to be directed to any one of said subsidiary imprint sections, in which said main imprint body is arranged in a central opening of said subsidiary imprint body such that the former is rotatable therein relative to the latter, whereby a desired combination of said main imprint section and one of the subsidiary imprint sections can be selectively attained by turning the main imprint body relative to the subsidiary imprint body, for example, by hand.

1 Claim, 6 Drawing Figures

SELF-INKING HAND STAMP

BACKGROUND OF THE INVENTION

The present invention relates to a stamp and, in more particular, to a stamp comprising a plurality of imprint sections for imprinting, for example, date, time, name of an organization or company and so on, in which a desired combination of one main imprint section and one of the remaining subsidiary imprint sections is selectively attainable.

In case of the prior art stamps of the type imprinting the date, time, or name of an organization or company, a part of the imprint section is arranged to be replaceable by hand. However, such operation of replacing the imprint section is very troublesome, as will be understood.

In case of another type of prior art stamps, they comprise a plurality of endless belts which are unabel to run around their endless passages so as to alternately represent a plurality of imprint sections carried on the endless belts. Since in the stamps of the above type it is required to make the width of the respective imprint section rather small so that the rotation of the endless belts may be rendered smooth, it was difficult to give a sufficient width to the imprint sections.

SUMMARY OF THE INVENTION

In light of the above, it is a primary object of the present invention to provide a stamp which is free from the difficulties of the prior art stamps.

It is another object of the invention to provide a stamp, in which a desired combination of one main imprint section and one of the remaining subsidiary imprint sections can be easily selected.

In summary, in accordance with the present invention, there is provided a stamp which comprises an annular subsidiary imprint body having on its surface a plurality of circumferentially arranged subsidiary imprint sections, and a discshaped main imprint body having on its surface a main imprint section and a marking to be directed to any one of said subsidiary imprint sections, which main imprint body is disposed in a central opening of said subsidiary imprint body, wherein said main imprint body and the subsidiary imprint body are arranged to be rotatable relative to each other.

DESCRIPTION OF THE PREFERRED EMBODIMENTS

Figure 1:
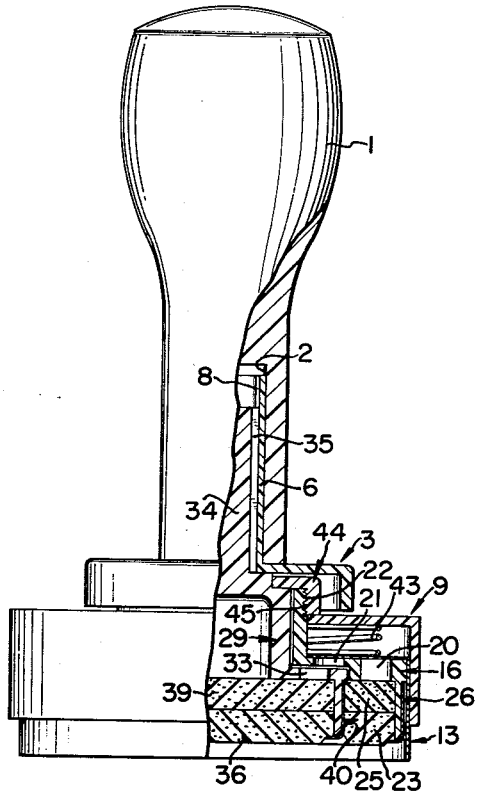
FIG. 1 is a front view showing, partly in longitudinal section, a stamp in accordance with one embodiment of the present invention.
Figure 2:
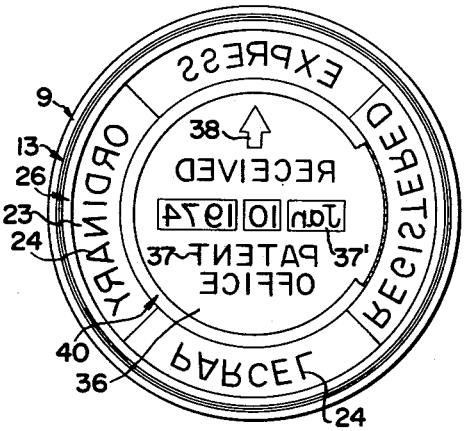
FIG. 2 is a bottom view of the stamp of FIG. 1.
Figures 3, 6:
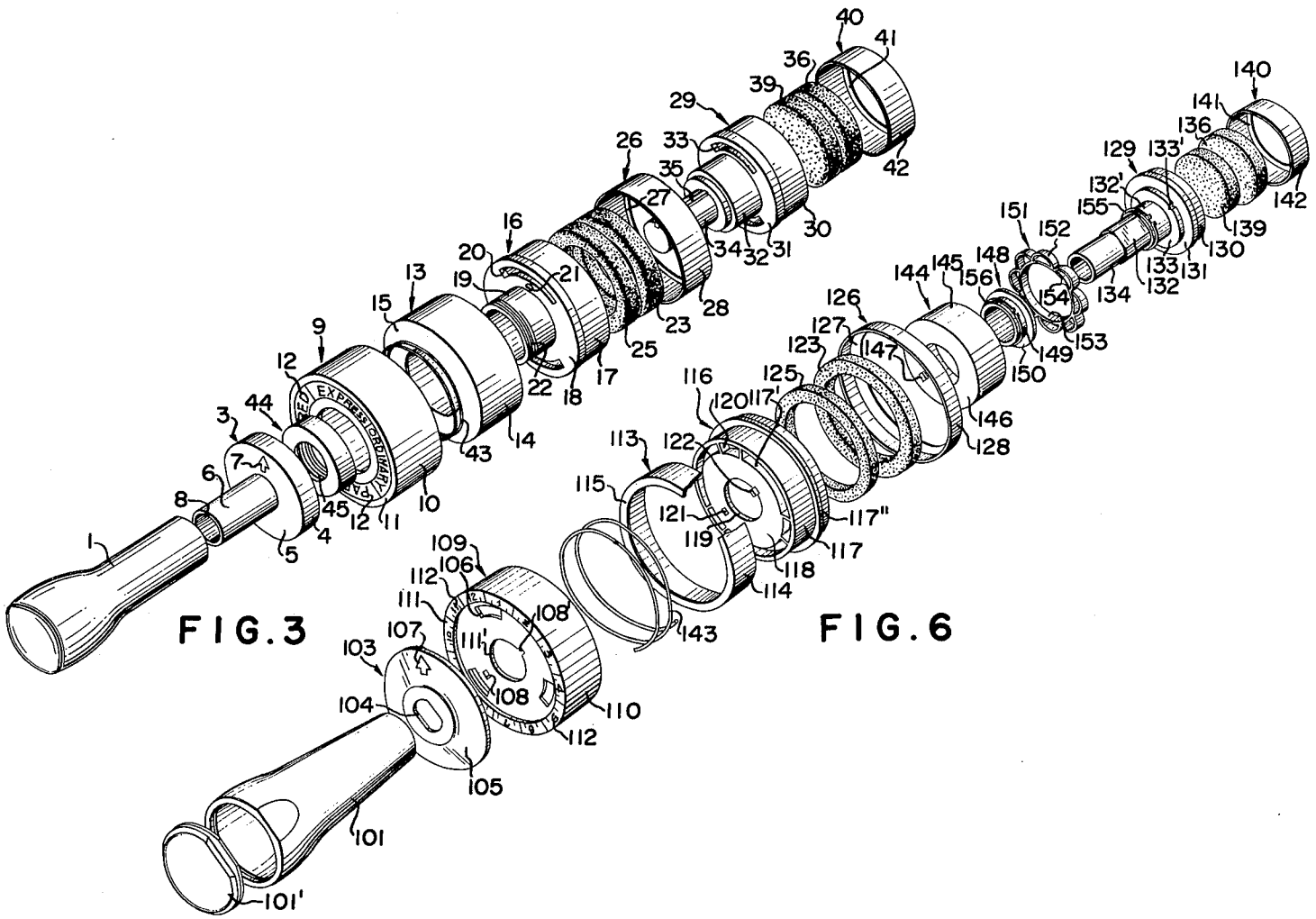
FIG. 3 is a disassembled view of the stamp of FIG. 1.
FIG. 6 is a disassembled view of the stamp of FIG. 4.

Referring to FIG. 1 to FIG. 3, of the drawings, there is illustrated a first embodiment of the present invention, in which a grip body 1 includes a cylindrical bore 2 at one end thereof.

A cover member 3 consists of an annular plate 5, an outer sleeve portion 4 arranged on the outer circumference of the annular plate 5 and an inner sleeve portion 6 arranged on the inner circumference of the annular plate 5. The inner sleeve portion 6 is provided with a key way 8 in its internal surface and is held tightly in the bore 2 of the grip body 1. The annular plate 5 carries a marking 7 on its upper surface.

An external sleeve member 9 consists of an annular plate 11 and a sleeve portion 10 arranged on the outer circumference of the annular plate 11. The annular plate 11 carries on its upper surface a plurality of circumferentially arranged indications 12, 12 for subsidiary imprint section which will be described in more detail later on.

An internal sleeve member 13 consists of an annular plate 15 and a sleeve portion 14 arranged on the outer circumference of the annular plate 15. This sleeve portion 14 is loosely fitted in the sleeve portion 10 of the external sleeve member 9.

An outer holder 16 consists of an annular plate 18, a sleeve portion 17 arranged on the outer circumference of the annular plate 18 and a sleeve portion 19 arranged on the inner circumference of the same. The annular plate 18 is provided with an arcuate ink supply port 20 and a small ink supply port 21. The sleeve portion 19 has an external thread 22 on its outer surfce, and is inserted into the central opening of the annular plate 15 of the internal sleeve member 13 and the central opening of the annular plate 11 of the external sleeve member 9.

An annular subsidiary imprint body 23 made of porous substance such as sponge rubber which has a plurality of continuous pores is provided on its surface with a plurality of circumferentially arranged subsidiary imprint sections 24, 24. These subsidiary imprint sections 24, 24 correspond to the aforementioned indications 12, 12 given on the annular plate 11 of the external sleeve member 9.

An annular ink absorbing and storing body 25 for the subsidiary imprint body 23 is inserted into the sleeve portion 17 of the outer holder 16. As the material for the ink absorbing and storing body 25, left and porous rubber can be used. Similarly, polyvinyl formal (percentage of ink is in the range of 60 – 90% in volume) with innumerable pores formed therein through formalizing reaction coupling formaldehyde with polyvinyl alcohol by the use of a catalyzer of acid and through addition and dissolution of soluble substance such as starch may also be used. This polyvinyl formal is particularly superior to other materials in respect of permeability, storing capacity and conductivity of ink.

The subsidiary imprint body 23 is superposed on the ink absorbing and storing body 25 and is fitted in the sleeve portion 17 of the outer holder 16. A retainer ring member 26 consists of a sleeve member 28 having at one end an radially inwardly extending flange 27. The sleeve member 28 is tightly fitted to the outer circumferential surface of the sleeve portion 17 of the outer holder 16, while the flange 27 is engaged with the peripheral portion of the subsidiary imprint body 23 to uphold or support the same. The sleeve portion 14 of the internal sleeve member 14 is loosely fitted on the outside of the sleeve member 28 of the retainer ring 26. An inner holder 29 consists of an annular plate 31 having a sleeve portion 30 on its outer circumference and a sleeve portion 32 on its inner circumference. The annular plate 31 is provided with an arcuate ink supply port 33. The sleeve portion 32 carries a central shaft 34 which is formed with a key or spline 35 extending parallel with the axis of the same.

The center shaft 34 is inserted into the sleeve portion of the cover member 3 by sliding the key 35 into the key way 8 of the cover member 3. At the same time, the sleeve portion 32 of the inner holder 29 is loosely fitted into the sleeve portion 19 of the outer holder 16.

A disc-like main imprint body 36 made of porous material such as sponge rubber which has a plurality of continuous pores is provided on its surface with a main imprint section 37 and a marking 38 for pointing one section from among said plurality of subsidiary imprint sections 24. Here, it is to be noted that the marking 38 corresponds to the afore-mentioned marking 7 given on the cover member 3.

A disc-like ink absorbing and storing body 39 for the main imprint body 36 is made of the material as described in connection with the ink absorbing and storing body 25, and is inserted into the sleeve portion 30 of the inner holder 29. The main imprint body 36 is superposed on the ink absorbing and storing body 39 and is also inserted into the sleeve portion 30 of the inner holder 29.

A retainer ring member or partition wall 40 consists of a sleeve member 42 having at one end a radially inwardly extending flange 41. This sleeve member 42 is tightly fitted on the outside of the sleeve portion 30 of the inner holder 29, while the flange 41 is engaged with the peripheral portion of the main imprint body 36 to uphold or support the same.

The sleeve member 42 of the retainer ring member 40 is loosely inserted into both of the central openings of the subsidiary imprint body 23 and the ink absorbing and storing body 25.

A coil spring 43 is interposed between the annular plate 11 of external sleeve member 9 and the annular plate 15 of internal sleeve member 13.

After the outer holder 16 is inserted into the inside of the internal sleeve member 13 and the external sleeve member 9, an annular lock member 44 is threaded onto the sleeve portion 19 of the external holder 16 by means of the external thread 22 and the internal thread 45.

The arcuate ink supply port 20 faces to the annular ink absorbing and storing body 25 so that ink can be supplied to the ink absorbing and storing body 25 through the ink supply port 20 and can be stored therein. The ink thus supplied and stored in the body 25 is gradually penetrated into the subsidiary imprint body 23.

In the meanwhile, the small ink supply port 21 serves to supply ink to the ink absorbing and storing body 39 through the arcuate ink supply port 33 so that the ink may be stored in the body 39. The ink thus supplied and stored therein is thereafter gradually penetrated into the main imprint body 36.

The sleeve portion 14 of the internal sleeve member 13 is of such a length that the foreward end of the same protrudes above the surfaces of the main imprint body 36 and the subsidiary imprint body 23. When the stamp is pressed onto the face of a paper, the coil spring 43 is contracted to retract the sleeve portion 14 rearward, whereby the main imprint body and the subsidiary imprint body can be brought against the face of the paper to imprint or stamp any characters or figures represented on the surfaces of the main imprint body and the subsidiary imprint body.

The main imprint section 37 of the main imprint body 36 carries, for example, letters "received" for the mail service, and the subsidiary imprint sections 24, 24 of the subsidiary imprint body 23 carry respectively the letters "ordinary", "express", "registered", "parcel" or the like. The annular plate 11 of the external sleeve member 9 carries thereon the same indications 12, 12 consisting of the letters "ordinary", "express", "registered" and "parcel".

When the grip body 1 is rotated relative to the external sleeve member 9 to bring the marking 7 of the cover member 3 to a position in front of the indication "express" of the external sleeve member 9, the marking 38 of the main imprint body 36 is also directed to the region "express" of the subsidiary imprint sections 24. By pressing the stamp onto the face of a paper in the above state, the letters "express" is imprinted on the paper.

In accordance with the present invention, a desired combination of the main imprint section of the main imprint body and one of the subsidiary impring sections of the subsidiary imprint body can be selected attained simply by rotating, by hand, the main imprint body relative to the subsidiary imprint body. Besides, it is possible by virtue of its structure to make the width of each of the subsidiary imprint sections considerably broad.

If inks of different colors are absorbed and stored in the respective ink absorbing and storing body, it is possible to apply different colors to the main imprint body and the subsidiary imprint body.

Likewise, it is also possible to use a special color for the marking 38 by supplying and storing an ink of the special color in the section of the main imprint body where the marking 38 is located, so that it may be rendered conspicuous.

In this case, it is of course necessary to confine the section of the marking 38 by means such as partition wall, so that the ink of the special color may not be mixed with the inks for the other sections.

Further, it is also possible to arrange another replaceable imprint section 37' for indicating, for example, date in the main imprint section 37. An ink of different color from the others can be supplied and stored also for this date indicating section 37'.

In this case also, it is necessary to confine this date indicating section 37' by means such as partition wall, so that the ink for the section 37' may not be mixed with the inks for the other sections.

Figure 4:
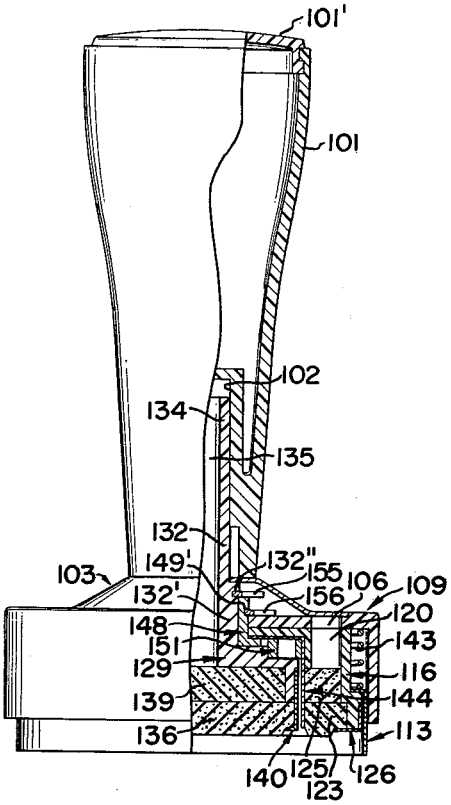
FIG. 4 is a front view showing, partly in longitudinal section, another embodiment of the invention.
Figure 5:
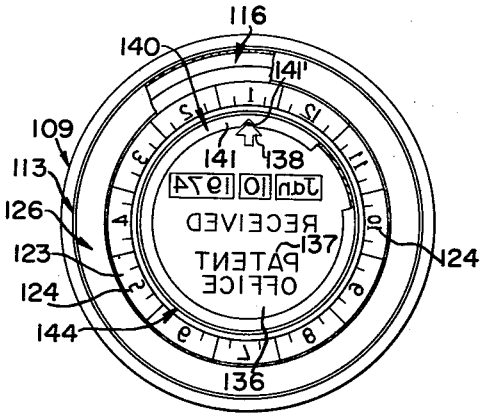
FIG. 5 is a bottom view of the stamp of FIG. 4.

In the another embodiment shown in FIGS. 4 to 6 of the drawings, a grip body 10 includes a cylindrical bore 102 at one end thereof and has a cap 101' carried on the other end.

A cover member 103 consists of a circular truncated cone member 105 provided with an elongated hole 104 at the central portion and carries a marking 107 on the upper surface of the cone member 105.

An external sleeve member 109 consists of an annular plate 111 having a sleeve portion 110 at its outer circumference, and a plurality of indications 112, 112 for subsidiary imprint sections are arranged circumferentially on the upper surface of the annular plate member 111. The annular plate member 111 further comprises a plurality of ink supply ports 106 and a connector port 108 at the inside of the indications 112, 112, and a notch 108' by the side of a central opening 111'.

An internal sleeve member 113 consists of an annular plate 115 having a sleeve portion 114 at the outer circumference, and the sleeve portion 114 is loosely fitted into the sleeve portion 110 of the external sleeve member 109.

An outer holder 116 consists of an annular plate 118 having an outer sleeve portion 117 at its outer circumference. The annular plate 118 further comprises an inner sleeve portion 117' at the inside of the outer sleeve 117, and there are provided ink supply ports 120, 120 between the inner sleeve 117' and the outer sleeve 117. The annular plate 118 further comprises a connector port 121 and a connector lug 122 at one side of a central opening 119. The outer sleeve 117 comprises a stepped portion 117'' on the outer peripheral portion thereof.

An annular subsidiary imprint body 123 is provided on its surface with a plurality of circumferentially arranged subsidiary imprint sections 124, 124, and these subsidiary imprint sections 124, 124 corresponds to the afore-mentioned indications 112, 112 of the external sleeve member 109.

An annular ink absorbing and storing body 125 for the subsidiary imprint body 123 is inserted into the outer sleeve 117 of the outer holder 116, while the subsidiary imprint body 123 is superposed on the ink absorbing and storing body 125 and inserted into the outer sleeve 117 of the outer holder 116. The material for the ink absorbing and storing body 125 could be the same as described in connection with the preceding embodiment.

A retainer ring member 126 consists of a sleeve member 128 having at one end an inwardly extending flange 127. The sleeve member 128 is tightly fitted on the outside of the outer sleeve portion 117 of the outer holder 116, while the flange 127 is engaged with the peripheral portion of the subsidiary imprint body 123 to uphold or support the same.

The annular plate 115 of the internal sleeve member rests on the stepped portion 117'' of the outer holder 116, and the sleeve portion 114 is loosely fitted on the outside of the sleeve member 128 of the retainer ring member 126.

An inner holder 129 consists of an annular plate 131 having a sleeve member 130 at its outer circumference, and has a stepped portion 133 on the annular plate 131. The annular plate 131 is provided with a notch 133' at one side of the stepped portion 133.

The annular plate 131 also includes a hollow circular sleeve 132' at its inner circumference. On this circular sleeve 132' is superposed a hollow polygonal sleeve 132, and on this polygonal sleeve 132 in turn is superposed a hollow shaft 134. The cross section of the polygonal sleeve 132 is analogous to the shape of the elongated hole 104 of the cover member 103.

The hollow space 135 provided inside the circular sleeve 132', the polygonal sleeve 132 and the hollow shaft 134 serves as an ink supply passage for supplying ink to the ink absorbing and storing body 139 which absorbs and stores ink to deliver it to the main imprint body 136.

A disc-like ink absorbing and storing body 139 for the main imprint body is inserted into the sleeve member 130 of the inner holder. The material for the disc-like ink absorbing and storing body 139 is selected from those as described in connection with the preceding embodiment.

The disc-like main imprint body 136 includes on its surface a main imprint section 137 and a marking 138 adapted for pointing one of the subsidiary imprint sections 124. The marking 138 corresponds to the marking 107 of the cover member 103. That is, these two markings are vertically in alignment with each other.

The main imprint body 136 is superposed in the ink absorbing and storing body 139, and the ink absorbing and storing body 139 is inserted into the sleeve member 130. In the meanwhile, the main imprint body 136 is inserted into a sleeve portion 142 of a retainer ring member 140 and its peripheral portion is supported by a flange 141 of the retainer ring member 140.

The retainer ring member 140 consists of a sleeve member 142 having at one end thereof a radially inwardly extending flange 141, and the sleeve member 142 is tightly fitted on the outside of the sleeve member 130 of the inner holder 129.

The inwardly extending flange 141 of the retainer ring member 140 is formed with a notch 141' in which the marking 138 of the main imprint body 136 is fitted as shown in FIG. 5. This arrangement is advantageous in that the marking 138 is located close to the subsidiary imprint sections 124 of the subsidiary imprint body 123 and therefore the operator can read, without mistake, the subsidiary imprint section which the marking 138 points.

A coil spring 143 is interposed between the annular plate 111 of the external sleeve member 109 and the annular plate 115 of the internal sleeve member 113.

A cover ring member 144 consists of an annular plate 146 having a sleeve portion 145 at its outer circumference. The annular plate 146 includes a projection 147 on the upper surface, and the sleeve portion 145 is tightly fitted in the inner sleeve portion 117' of the outer holer 116 such that the annular plate 146 may be in contact with the lower surface of the annular plate 118 of the outer holder 116.

A short sleeve member 148 consists of an annular plate 150 and a sleeve portion 149 attached on the inner circumference of the annular plate 150. The sleeve portion 149 is provided with a groove 149' at its outer circumference. The sleeve portion 132' of the inner holder 129 is inserted into the short sleeve member 148. The sleeve portion 149 of the short sleeve member 148 extends through the central openings formed in each of the annular plates 146, 118 and 111 of the cover ring member 144, outer holder 116 and ecternal sleeve member 109, respectively. In the groove 149' provided in the sleeve portion 149 of the short sleeve member 148 is fitted a snap ring 156. An anti-slip spring 151 is fitted around the stepped portion 133 of the inner holder 129 and is held in place between the stepped portion 133 and the sleeve portion 145 of the cover ring member 144.

This anti-slip spring 151 consists of an annular outer spring 152 including a number of corrugations and an annular inner plate spring 153. The inner plate spring 153 is provided with a projection 154 on the inner surface, which projection is inserted into the notch 133' formed in the stepped portion 133.

The anti-slip spring 151 is preferably made of resilient metal material or plastics such as polyacetal resin, polyamide resin, polypropylene resin or the like.

The sleeve portion 149 of the short sleeve member 148 is rotatably fitted into the circular sleeve portion 132' of the inner holder 129, and a snap ring 155 is fitted in the groove 132'' of the circular sleeve portion 132'.

The projection 122 of the outer holder 116 is fitted in the notch 108' of the external sleeve member 109, and the projection 147 of the cover ring member 144 is fitted in the port 108 of the external sleeve member 109. The ink supply port 120 of the outer holder 116 and the ink supply port 106 of the external sleeve member 109 are located such that they may be in registry with each other.

Since the anti-slip spring 151 is interposed between the outer holder 116 and the inner holder 129, relative rotation between these two holders does not occur.

Therefore, upon practical use of the stamp under such circumstance where the marking 138 of the main imprint section 137 is directed to one of the subsidiary imprint sections 124 by relatively rotating the main imprint body 136 and the subsidiary imprint body 123 by hand, it is positively avoided that the marking 138 on the main imprint body 136 is slipped out of alignment with said one of the subsidiary imprint sections, for example, under the shock at the time of stamping. Thus, by virtue of the above arrangement, it is not necessary to correct the displacement between the marking 138 and the subsidiary imprint sections 124, as was often the case with the prior art stamps.

However, it is to be noted that the provision of the anti-slip spring 151 interposed between the outer holder 116 and the inner holder 129 is only for the purpose that the marking 138 may not easily be rotated and slipped out of registry with the preselected one of the subsidiary impring sections 124, for example, under the shock at the time of stamping as described in the above. Therefore, in case that other different combination of the main imprint section 137 and the subsidiary imprint section 124 is required, it is possible to rotate the main imprint body 136 relative to the subsidiary imprint body 123 by turning the grip body 101, for example, by hand.

While there have been shown and described in the above several embodiments of the present invention, modifications thereto will readily occur to those skilled in the art. It is not intended, therefore, that the invention be limited to the specific arrangements shown and described and it is intended to cover in the appended claims all such modifications as fall within the spirit and scope of the invention.

What is claimed is:

1. In a stamp comprising an annular subsidiary imprint body having on its surface a plurality of circumferentially arranged subsidiary imprint sections, and a disc-shaped main imprint body having on its surface a main imprint section and a marking to be directed to any one of said subsidiary imprint sections, said main imprint body being disposed in a central opening of said subsidiary imprint body, said main imprint body and said subsidiary imprint body being arranged to be rotatable relative to each other and both made of porous material having a plurality of continuous pores, the improvement which comprises at least one partition wall interposed between said main imprint body and said subsidiary imprint body and tightly fitted on said main imprint body, means provided inside of said partition wall for supplying ink into said main imprint body, and means provided outside of said partition wall for supplying ink into said subsidiary imprint body, said main imprint body including on its surface a marking for pointing to one of the subsidiary imprint sections and being inserted into a sleeve portion of a retainer ring member, a peripheral portion of said main imprint body being supported by a flange of the retaining ring member, and said flange being formed with a notch in which the marking is fitted.

* * * * *